US005772457A

United States Patent [19]

Cairns

[11] Patent Number: 5,772,457

[45] Date of Patent: Jun. 30, 1998

[54] CONVERTIBLE DRY-MATE TO WET-MATE SUBMERSIBLE ELECTRICAL CONNECTOR SYSTEM

[75] Inventor: James L. Cairns, Ormond Beach, Fla.

[73] Assignee: Ocean Design, Inc., Ormond Beach, Fla.

[21] Appl. No.: 441,057

[22] Filed: May 15, 1995

[51] Int. Cl.[6] ..... H01R 4/60

[52] U.S. Cl. ..... 439/201; 439/207

[58] Field of Search ..... 439/190, 191, 439/199, 200, 201, 204, 271, 277, 283

[56] References Cited

U.S. PATENT DOCUMENTS

| | | | |
|---|---|---|---|
| 2,949,642 | 8/1960 | Lieberman | 439/323 |
| 4,218,110 | 8/1980 | Giannaula | 439/323 |
| 4,373,767 | 2/1983 | Cairns | 439/199 |
| 4,948,377 | 8/1990 | Cairns | 439/201 |
| 5,194,012 | 3/1993 | Cairns | 439/201 |
| 5,203,805 | 4/1993 | Cairns | 439/201 |

*Primary Examiner*—Hien Vu

*Attorney, Agent, or Firm*—Brown, Martin, Haller & McClain, LLP

[57] ABSTRACT

An adapter, mateable between two electrical connectors, has a shell with an internal chamber, and electrically-conductive socket assemblies extending through the chamber. The chamber has a vent to the external environment. A piston in the end of each of the socket assemblies is moveable between an extended position and a depressed position. Each socket assembly has one or more socket assembly vents. A flexible bladder within the chamber, filled with dielectric fluid, encases a portion of each socket assembly in which the socket assembly vents are located. The chamber vent allows communication of fluid between the chamber and the external environment. One end of each socket assembly has a contact that is engageable with a respective contact of the first electrical connector, and the other end of each socket assembly has a contact that is engageable with a respective contact of the second connector. When the piston is in the extended position, it seals the shell to prevent exposure of the socket assembly to the external environment. When the second connector is mated with the adapter, each contact pin of the second connector depresses a corresponding piston of the adapter and allows the contact pin to make electrical contact with the socket assembly. The second connector can be mated and demated with the adapter in an underwater environment because the adapter is pressure-balanced with the water in which it is submerged.

17 Claims, 4 Drawing Sheets

CONVERTIBLE DRY-MATE TO WET-MATE SUBMERSIBLE ELECTRICAL CONNECTOR SYSTEM

BACKGROUND OF THE INVENTION

1. Field of the Invention

The present invention relates generally to submersible electrical connectors and to adapters for facilitating mating of electrical connectors.

2. Description of the Related Art

Submersible electrical connectors may be of the dry-mate type or the wet-mate type. Dry-mate connectors cannot be mated while underwater, but rather must be mated before they are submerged. Wet-mate connectors can be mated and demated while underwater. Wet-mate connectors may use a simple interference-fit sealing mechanism that includes elastomeric seals. The elastomeric seats substantially force the water out of the contact area and seal the contact area from the outside environment. Other wet-mate connectors may use a dielectric fluid-filled chamber. The chamber, which is in the female or receptacle side of the connector, is penetrated by plug pins having insulated shafts, which are in the plug or male side of the connector. The purpose of these sealed, fluid-filled connectors is to insulate the electrical junctions from the outside environment by enclosing them within a chamber, or chambers, of dielectric fluid. These fluid-filled connectors offer many advantages over the other types. They are spark-proof, and therefore can be mated and demated with the receptacle electrically energized. They include the additional safety feature that if the connector plug is inadvertently disconnected from the receptacle while the receptacle is energized, or if a circuit is accidentally energized in the unmated condition, they remain "dead-faced" to the outside environment, preventing short circuits. A large body of existing art is exemplified by U.S. Pat. Nos. 5,194,012 and 4,948,377; issued to Cairns, U.S. Pat. No. 4,795,359, issued to Alcock, and U.S. Pat. No. 4,039,242, issued to Wilson.

In many permanent and semi-permanent installations, such as hull penetrators on military submarines, connectors of the dry-mate type have been used. The inability of these connectors to be mated or demated underwater presents operational problems. Damaged cables or faulty equipment cannot be changed-out without either putting a submarine in dry-dock or building uneconomical coffer dams in the work area. These problems and deficiencies are clearly felt in the art and are solved by the present invention in the manner described below.

SUMMARY OF THE INVENTION

The present invention comprises an adapter for converting a dry-mate connector into a fluid-filled and pressure-balanced wet-mate connector that can be mated and demated while submerged. The proximal end of the adapter is connectable to a first connector, which is of dry-mate type. The first connector may be male or female. The distal end of the adapter is connectable to a second, male connector, which is of the wet-mate type. The present invention also comprises first and second connectors that are mateable with the adapter.

The adapter comprises an exterior shell having a main chamber and a plurality of ports in its distal end for receiving the contact pins of the second, male connector. A plurality of electrically-conductive socket assemblies is disposed within the main chamber, each in alignment with a respective one of the ports. The main chamber has at least one vent to the external environment. A moveable piston is disposed in the distal end of each of the socket assemblies. The piston is moveable in the port between an extended position and a depressed position. An end-seal in each respective port constricts the passageway into sealing engagement with the piston.

Each socket assembly is pressure-compensated to the ambient external environment via one or more resilient elements or bladders filled with dielectric fluid. Each socket assembly has one or more socket assembly vents. A flexible bladder within the main chamber, filled with dielectric fluid, may encase at least the portion of each socket assembly in which the socket assembly vents are located. The exterior of the bladder is in fluid communication with the external environment via the main chamber vents. The pressure inside the socket assemblies is thereby equalized to the pressure of the external environment. Alternatively, or in addition, each of a plurality of flexible bladders or sleeves may encase the portion of each socket assembly in which the socket assembly vents are located, thereby preventing communication of dielectric fluid between the socket assembly and the main chamber via the socket assembly vents. Each socket assembly has at its proximal end a first contact that is engageable with a respective contact of the first connector and has at its distal end a second contact that is engageable with a respective contact of the second connector. When the piston is in the extended position, it seals the port to prevent exposure of the second contact to the external environment.

The surfaces of each socket assembly, with the exception of the portions that are intended to complete the electrical connections with the conductive contacts of the first and second connectors, are preferably coated with a thin-film dielectric coating. The coating is not detrimentally affected by most corrosive agents, including seawater. The coating forms an environmental and electrical barrier between the socket assembly and the fluid of the main chamber. Thus, even if some seawater should intrude the main chamber, the coating minimizes the likelihood that the seawater will bridge the gap to form an electrically conductive path between exposed conductive portions of neighboring socket assemblies.

The exterior shell within which is housed the socket assemblies has a first locking mechanism for securing the adapter to the exterior shell of the first connector, and a second locking mechanism for securing the adapter to the exterior shell of the second connector. The shell may also include an alignment mechanism, such as a key or a slot, that engages a corresponding mechanism on the first connector for rotationally aligning the adapter with the connector.

To use the adapter, it should first be dry-mated to the first connector. When the adapter is mated to the first connector, the adapter can then be wet-mated to the second connector and wet-demated from the second connector.

The foregoing, together with other features and advantages of the present invention, will become more apparent when referring to the following specification, claims, and accompanying drawings.

DESCRIPTION OF THE DRAWINGS

For a more complete understanding of the present invention, reference is now made to the following detailed description of the embodiments illustrated in the accompanying drawings, wherein.

DESCRIPTION OF A PREFERRED EMBODIMENT

Figure 1:
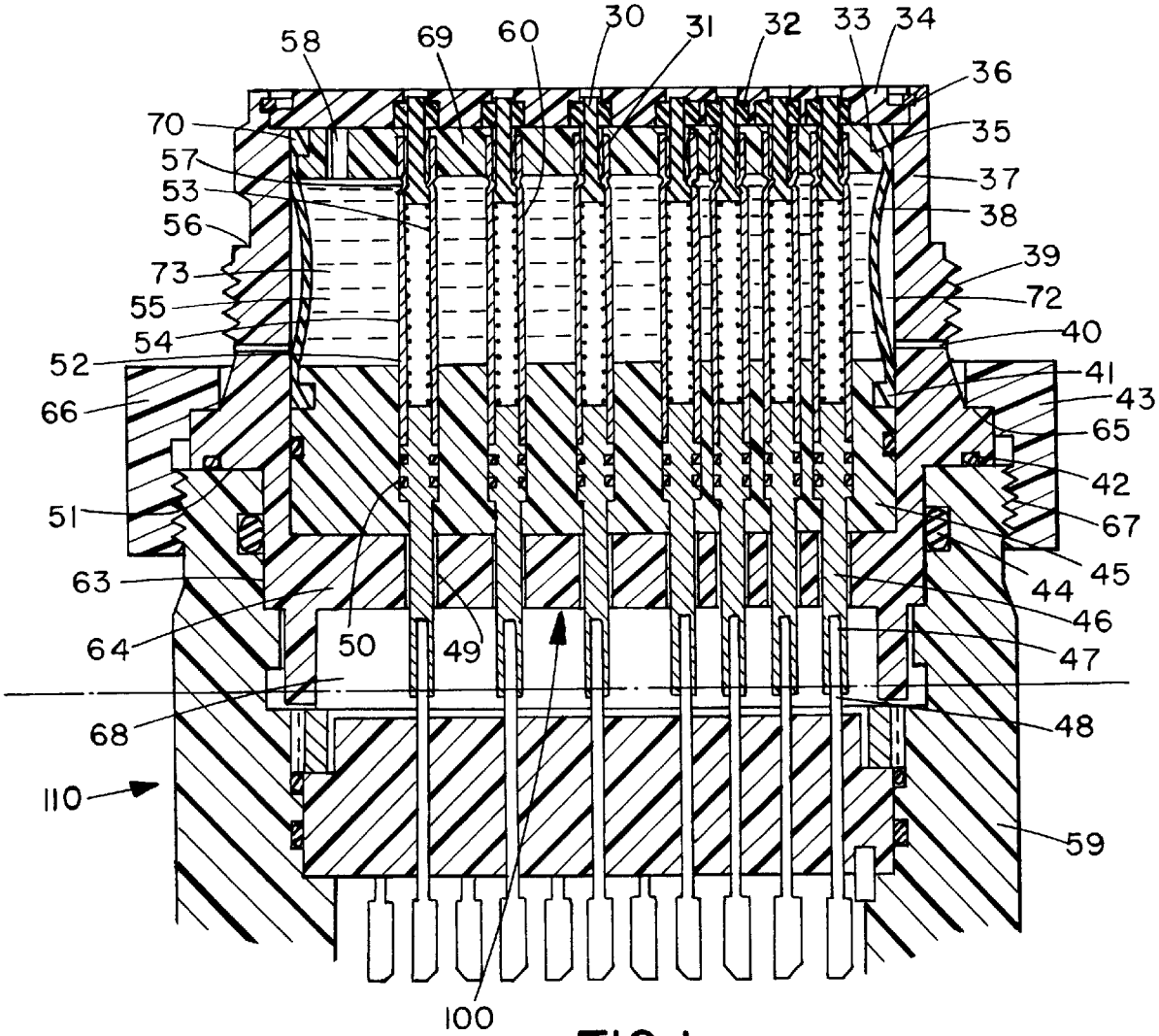
FIG. 1 is a sectional view of the adapter of the present invention taken on line 1—1 of FIG. 2, showing it mated with a first connector.

As illustrated in FIG. 1, an adapter 100 of the present invention is mated with a male dry-mate connector 110. Adapter 100, in turn, may be wet-mated with a male wet-mate connector, such as that illustrated in FIG. 5. In other embodiments, however, the dry-mate connector may be female. When adapter 100 is not mated to dry-mate connector 110, a second dry-mate connector (not shown) may be mated with dry-mate connector 110. If the second dry-mate connector is female, it may be mated directly with male dry-mate connector 110. If the second dry-mate connector is male, a suitable male-to-female conversion adapter (not shown) should be used to mate the second connector with dry-mate connector 110.

Dry-mate connector 110 comprises a generally cylindrical dry-mate connector shell 59, multiple electrically conductive contact pins 48, and a main O-ring 44.

Figure 2:
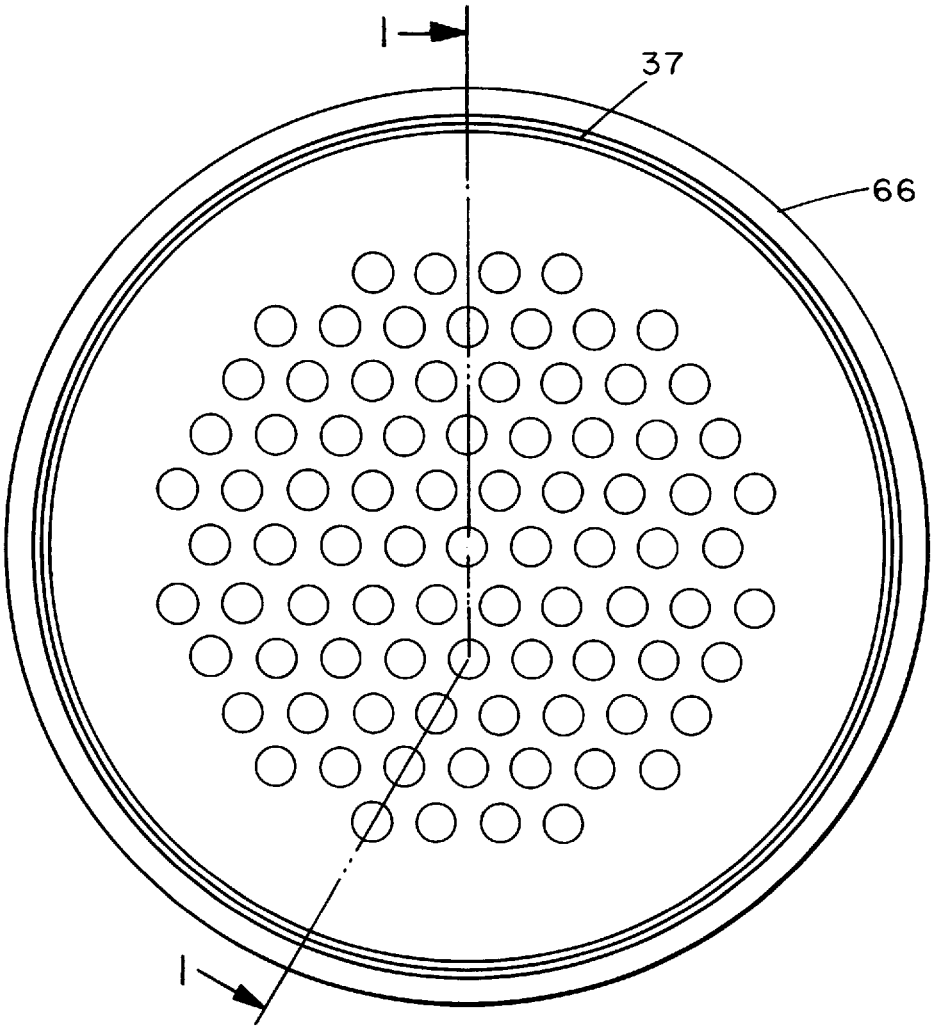
FIG. 2 is an end view of the adapter.

As illustrated in FIGS. 1 and 2, adapter 100 comprises a generally cylindrical adapter shell 37, multiple socket assemblies 60, an elastomeric bladder 38, and a face-seal O-ring 42, which is seated in a projecting flange 51 of adapter shell 37.

Adapter 100 mates mechanically with dry-mate connector 110 and forms a fluid-tight seal. An internally threaded adapter engagement ring 66 engages corresponding threads 67 of dry-mate connector receptacle shell 59. A shoulder 65 on adapter shell 37 is captured by a corresponding shoulder in engagement ring 66. When adapter 100 is mated, to dry-mate connector 110, main O-ring 44 forms a fluid-tight seal between dry-mate connector shell 59 and the cylindrical wall 63 of adapter shell 37, and face-seal O-ring 42 forms a fluid-tight seal between dry-mate connector shell 59 and projecting flange 51 of adapter shell 37.

Adapter 100 also mates electrically with dry-mate connector 110. Socket assemblies 60 are housed within adapter shell 37. As shown in further detail in FIGS. 3 and 4, each socket assembly 60 comprises an electrically conductive tube 52, a conductive shaft 46 friction-fit in the proximal end of tube 52, an elastomeric piston 30 in the distal end of tube 52, a spring 53, and an electrical contact band 31 in the distal end of tube 52. Shaft 46 has an electrical contact socket 47 at its proximal end, and two O-rings 50 retained in annular grooves in the large-diameter portion 62. Spring 53 biases piston 30 toward the distal end of adapter 100. Tube 52 has inwardly directed dimples 57 that engage contact band 31 to retain it at the distal end of tube 52 and also engage the enlarged shoulder portion 61 of piston 30 to prevent it from escaping the distal end of adapter 100. Spring 53 is captured within tube 57 between the distal end of shaft 46 and enlarged shoulder portion 61 of piston 30.

When the force exerted by spring 53 extends piston 30, piston 30 seals the interior of socket assembly 60 against exposure to the external environment. When the pins of a second connector (see FIG. 5) are inserted into the corresponding distal ends of a socket assemblies 60, they urge pistons 30 inwardly and compress spring 53, thereby exposing contact bands 31. The pins of the second connector can thus make electrical contact with contact bands 31. Socket assemblies 60 thus transmit electrical power between contact pins 48 of connector 110 and the pins of the second connector.

Referring again to FIG. 1, shafts 46 extend through bores 49 of shell 37. Bores 49 retain the proximal ends of socket assemblies 60 in position. An interior wall 64 of shell 37 cooperates with main O-ring 44 to form a high pressure barrier that prevents penetration of fluid from the external environment into the space 68 between adapter 100 and dry-mate connector 110. An insert 45 is housed in shell 37. O-rings 50 form a seal between shafts 46 and insert 45. An O-ring 43 forms a seal between insert 45 and shell 37. Elastomeric bladder 38 is captured between insert 45 and a plate 69 that caps the distal end of shell 37. A proximal flange 41 of bladder 38 is retained in an annular shoulder in insert 45, and a distal flange 70 of bladder 38 is retained in an annular shoulder 35 in plate 69. The cavity 55 defined by bladder 38, insert 45 and plate 69 is filled with a dielectric fluid 73.

Plate 69 is made of a rigid, non-conductive material. Plate 69 has multiple openings or ports into which the distal ends of socket assemblies 60 extend. Plate 69 thus maintains socket assemblies 60 in position. Each port has a shoulder 33 that rests on the distal end of the respective socket assembly 60. A fill-hole 58 in plate 69 allows cavity 55 to be filled with dielectric fluid during assembly of adapter 100.

An endcap 34, which is made of a rigid plastic material, is disposed at the extreme distal end of adapter 100. Endcap 34 has a plurality of openings or ports corresponding to those in plate 69. An elastomeric gland seal 32 is retained in each port by an annular shoulder. Seals 32 form a fluid-tight seal between endcap 34 and pistons 30 when pistons 30 are in the extended position, as described above, A snap ring 36 snaps into the aligned shoulders in end cap 34 and the extreme distal end of shell 37 to 20 capture endcap 34. Alignment keys (not shown) maintain alignment between plate 69 and endcap 34, and between endcap 34 and shell 37.

Vent holes 40 through shell 37 allow the free ingress and egress of environmental fluid into the space 72 between the internal wall of shell 37 and the external wall of elastomeric bladder 38. The pressure experienced by the external wall of bladder 38 is transferred to fluid 73 within cavity 55.

Figure 3:
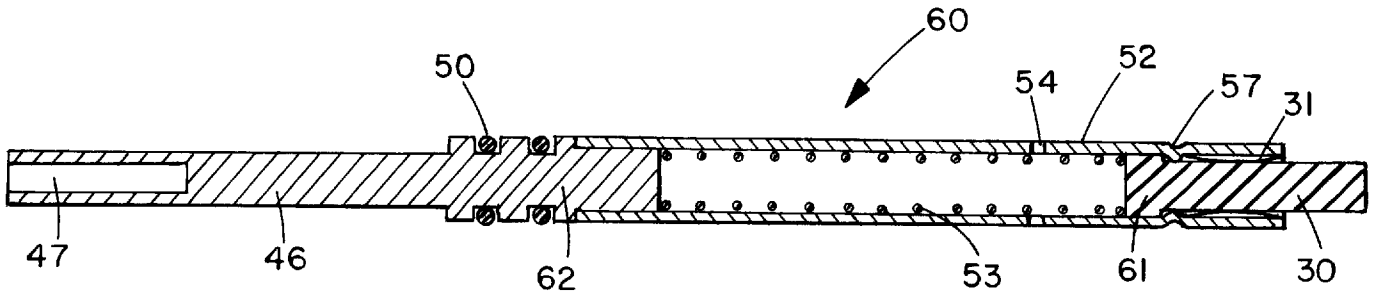
FIG. 3 is a sectional view of a socket assembly of the adapter.
Figure 4:
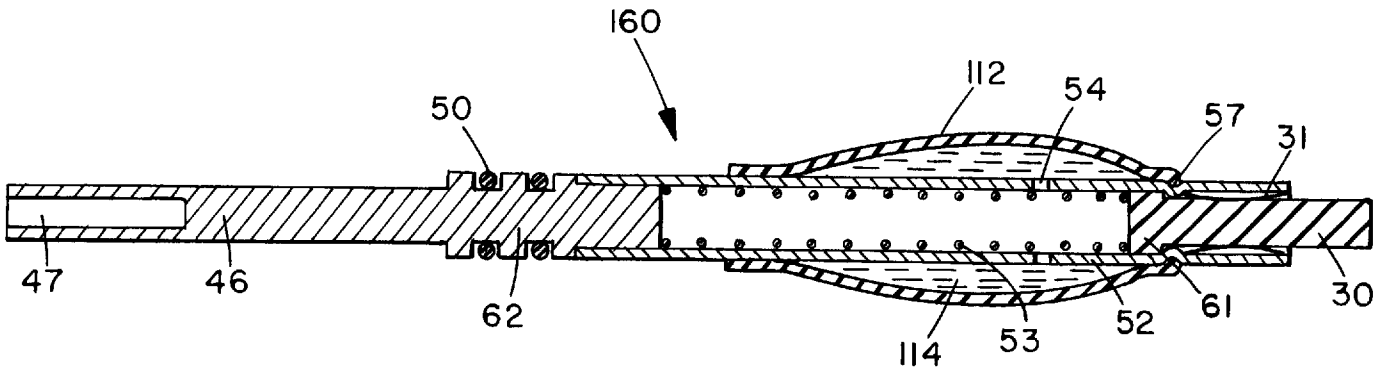
FIG. 4 is a sectional view of an alternative socket assembly of the adapter.

As shown in further detail in FIGS. 3 and 4, each socket assembly 60 has vents 54 that allow the free communication of fluid 73 with the interior of socket assembly 60. The ambient pressure of the external environment therefore is experience by the innermost portions of adapter 100. Because the pressure internal to adapter 100 is equal to the pressure external to adapter 100, there is no compressive force that tends to either force fluid from the external environment into the interior of the adapter 100 or force fluid 73 from the interior of adapter 100 to the external environment. Nor is there any compressive force tending to displace pistons 30.

All conductive surfaces of socket assemblies 60 except for electrical contact sockets 47, electrical contact bands 31, and the interior surfaces of the distal ends of tubes 52 that contact electrical contact bands 31, are coated with a thin dielectric conformal film. The film provides insulation between neighboring socket assemblies 60 in the event of intrusion of a conductive fluid, such as seawater, from the external environment into cavity 55.

As illustrated in FIG. 4, an alternative socket assembly 160 includes a sleeve-like elastomeric bladder 112 around the portion of tube 52 in which vents 54 are disposed. Bladder 112 is filled with dielectric fluid 114, which is freely communicated with the interior of tube 52 via vents 54. Bladder 112 separates dielectric fluid 114 from dielectric fluid 73 in cavity 55 (FIG. 1) but facilitates equalization of their pressures. Socket assembly 160 thus provides additional insulation while equalizing pressures in the same manner as bladder 38.

Figure 5:
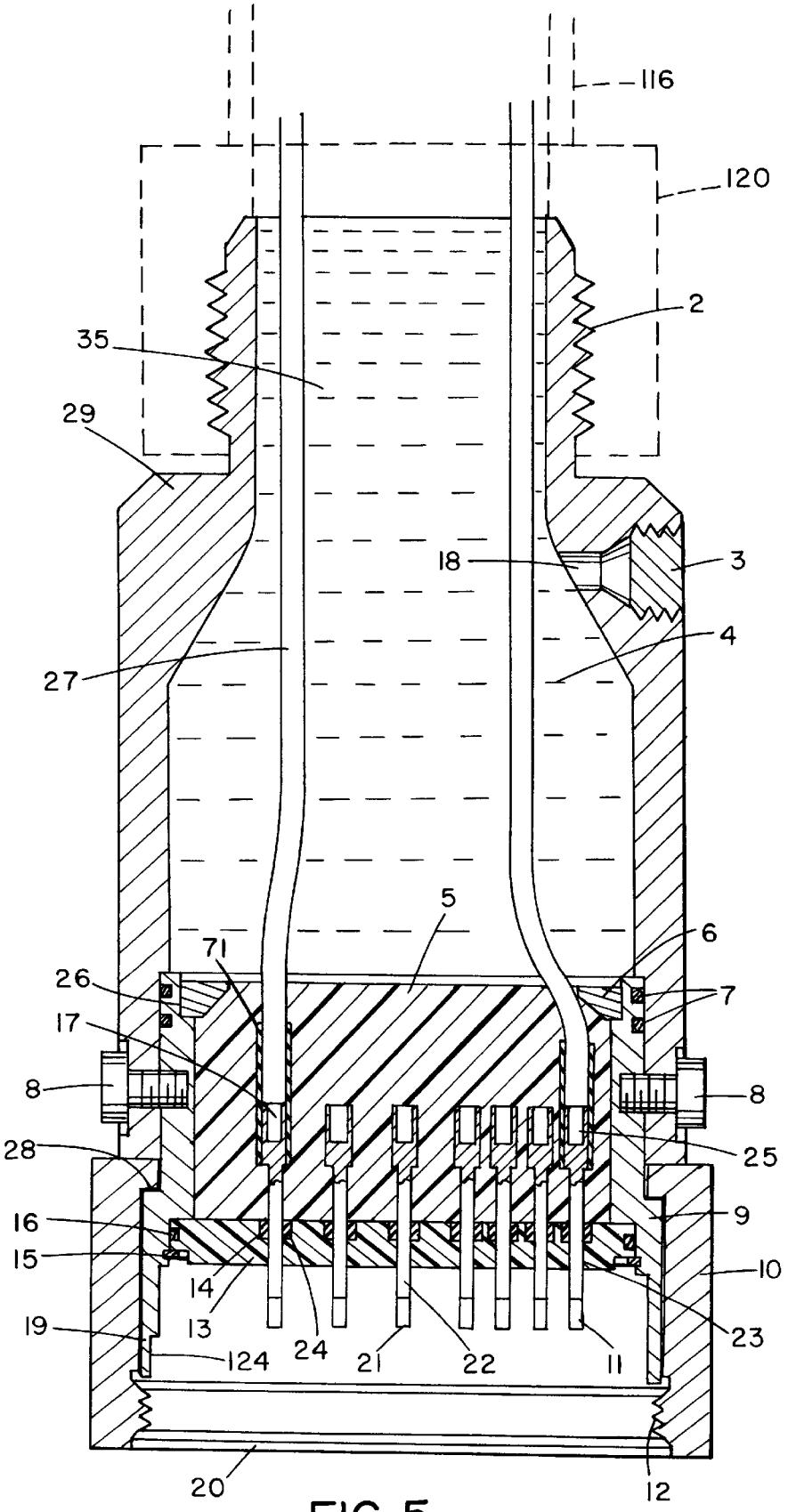
FIG. 5 is a sectional view of a second connector that is mateable with the adapter.

As illustrated in FIG. 5, a second connector that is wet-mateable with the distal end of adapter 100 comprises a generally cylindrical termination shell 29, a plug shell 9, and multiple electrical contact pins 11. Pins 11 have conductive tips 21, shafts 22 coated with an insulating material, and solder pots 25. The second connector also comprises an end plate 13 made of a rigid dielectric material. End plate 13 has multiple bores 23 that retain pins 11. End plate 13 provides a close-tolerance fit between bores 23 and insulated shafts 22, maintaining pins 11 in position. An elastomeric gland seal 14 is retained in each bore 23 by an annular shoulder 24. Gland seals 14 form fluid-tight seals between insulated shafts 22 and bores 23. An O-ring 16 is retained in an annular groove in end plate 13 and forms a fluid-tight seal between shell 9 and end plate 13. A snap ring 15, which snaps into aligned shoulders in endcap 34 and shell 9, captures end plate 13.

Multiple insulated wires 27, each comprising a center conductor and an insulating jacket, and each corresponding to a pin 11, are soldered, crimp-fit, or otherwise electrically and mechanically connected to their corresponding pins 11. A sleeve seal 71 seals the gap where the conductor of each insulated wire 27 exits from its jacket and enters solder pot 25. Sleeve seal 71 extends over a portion of insulated shaft 22 and a portion of the insulting jacket of wire 27. Sleeve seals 71 are encapsulated in a dielectric base 5.

To facilitate assembly of the above-described portions of the second connector, end plate 13 may first be mounted in plug shell 9 and pins 11 soldered to wires 27 and encased in sleeves 71. The resulting pin assemblies may then be pressed through seals 14 and through the corresponding bores 23. A simple assembly fixture (not shown) may be used to temporarily secure pins 11 in a position in which each protrudes a predetermined distance through end plate 13. A beveled snap ring 6 may then be inserted into an annular groove 26 in plug shell 9. Plug shell 9 may then be placed vertically with the ends of solder pots 25 pointing upwardly. A dielectric encapsulant may be poured into plug shell 9, curing to form dielectric base 5. The function of snap ring 6 is to retain the cured encapsulant mechanically within plug shell 9. The inner surface of snap ring 6 is beveled upwardly to facilitate the escape of air from the liquid encapsulant during curing.

A rotatable locking ring 10 is used to secure the proximal end 20 of the second connector to the distal end of adapter 100. Locking ring 10 engages an annular flange 28 of plug shell 9 and can be freely rotated with respect to plug shell 9. When the second connector is mated with adapter 100, an internally threaded portion 12 of locking ring 10 engages threads 39 of adapter 100.

Termination shell 29 engages the distal end of plug shell 9. Two O-rings 7, retained in an annular grooves in plug shell 9, form a fluid-tight seal between plug shell 9 and termination shell 29. Attachment bolts 8 secure termination shell 29 to plug shell 9.

The second connector may be attached to a hydraulic hose 116 having a standard JIC hydraulic fitting 120. Fitting 120 engages threaded portion 2 of termination shell 29. Wires 27 are loosely bundled within hose 116. Cavity 30, comprising the interior of shell 29 and attached hydraulic hose 116, may be filled with dielectric fluid 4 through a passage 18 in shell, 29. A threaded, removable plug 3 closes passage 18. Cavity 30 is thus pressure-compensated to the outside environment, because hose 116 may be compressed in response to ambient external pressure.

To convert dry-mate connector 110 to a wet-mate connector, the proximal end of adapter 100 is inserted into the distal end of dry-mate connector 110, with contact pins 48 of dry-mate connector 110 entering into contact sockets 47 of adapter 100. Adapter engagement ring 66 is then rotated to engage threads 67 and secure adapter 100 to dry-mate connector 100. The resulting assembly may then be wet-mated to the second connector shown in FIG. 5.

To mate the second connector (FIG. 5) to adapter 100, the proximal end 20 of the second connector is inserted over the distal end of adapter 100, with contact pins 11 of the second connector penetrating the ports in the distal end of adapter 100. A key 122 extending radially from adapter shell 37 engages a slot 124 in the extension 19 of plug shell 9 to facilitate rotational alignment of the second connector with adapter 100. Locking ring 10 may then be rotated to engage the threaded portion 39 of adapter shell 37. Extension 19 forms a close, but not sealed, engagement with the exterior surface of receptacle shell 37.

As pins 11 penetrate the ports in the distal end of adapter 100, they depress pistons 30. When the face surface of extension 19 abuts a shoulder 56 of adapter shell 37, conductive tips 21 of the second connector are in electrical contact with contact bands 31 of adapter 100, and gland seals 32 form fluid-tight seals between insulated shafts 22 and adapter 100.

Conductive tips 21 of the second connector are the only exposed elements that may be energized prior to engagement. After engagement, conductive tips 21 are completely enclosed within the fluid-filled tubes 52 of socket assemblies 60, sealed-off from the outside environment. The resulting circuits are, therefore, completely electrically isolated from the outside environment in the fully mated condition.

The electrical circuit elements within adapter 100 may remain electrically energized at all times before, during and after mating. Before mating, pistons 30 cooperate with seals 32 to insulate any internal electrically energized circuit elements from the outside environment. During mating, insulated shafts 22 of contact pins 11 are engaged in seals 32 prior to making electrical contact with contact bands 31. The second connector may be demated from adapter 100 by performing the above-described steps in reverse order. Therefore, at all times, socket assemblies 60 of adapter 100 remain electrically isolated from the outside environment.

Obviously, other embodiments and modifications of the present invention will occur readily to those of ordinary skill in the art in view of these teachings. Therefore, this invention is to be limited, only by the following claims, which include all such other embodiments and modifications when viewed in conjunction with the above specification and accompanying drawings.

What is claimed is:

1. An adapter for connecting a first electrical connector to a second electrical connector, comprising:

an adapter shell having an interior chamber, a first engagement at a proximal end of said shell engageable with said first electrical connector, a second engagement at a distal end of said shell engageable with said second electrical connector, and a plurality of openings between said interior chamber and an external environment;

a plurality of socket assemblies disposed at least partially in said chamber, each having a distal end and a proximal end, each socket assembly comprising in said chamber a piston and a conductive tube, said piston slideably disposed in said conductive tube at said distal end of said socket assembly, a first electrical contact at said proximal end of said socket assembly electrically connected to said tube, and a second electrical contact at said distal end of said socket assembly electrically connected to said tube, said piston movable into sealing engagement with one of said openings for sealing said second electrical contact against exposure to said external environment; and at least one bladder containing dielectric fluid disposed in said chamber, at least a portion of said bladder enclosing at least one of said socket assemblies.

2. The adapter claimed in claim 1, wherein said bladder encloses at least a portion of each said socket assembly, said portion immersed in said dielectric fluid.

3. The adapter claimed in claim 2, wherein said tube is coated with a dielectric coating, and said second electrical contact is disposed inside said tube.

4. The adapter claimed in claim 2, wherein said tube has a vent for communicating said dielectric fluid.

5. The adapter claimed in claim 1, wherein each said socket assembly further comprises a plurality of gland seals, each disposed in one said opening for sealably engaging one of said pistons.

6. The adapter claimed in claim 1, wherein said piston elastomerically seals said opening.

7. The adapter claimed in claim 1, wherein each said socket assembly further comprises a spring disposed in said tube for biasing said piston in a direction from said proximal end toward said distal end.

8. The adapter claimed in claim 1, wherein said first electrical contact comprises a receptacle for mating with an electrical contact probe of said first electrical connector.

9. The adapter claimed in claim 1, wherein said first and second engagements each comprise an annular threaded portion.

10. The adapter claimed in claim 9, wherein said first engagement comprises an internally threaded rotatable ring.

11. The adapter claimed in claim 1, wherein said at least one bladder comprises a main chamber bladder enclosing a portion of each of said socket assemblies.

12. The adapter claimed in claim 1, wherein said at least one bladder comprises a plurality of socket assembly bladders, each enclosing a portion of one of said socket assemblies.

13. A convertible electrical connector system, comprising:

a first connector having a plurality of electrical contacts at a distal end;

a second connector comprises a shell containing dielectric fluid and having a plurality of electrical contacts at a proximal end; and an adapter having a proximal end removably engageable with said distal end of said first connector and having a distal end removably engageable with said proximal end of said second connector, said adapter comprising a shell having a main chamber and a vent providing fluid communication between said main chamber and an external environment, and at least one bladder disposed in said main chamber experiencing pressure exerted by said external environment via said vent.

14. The convertible electrical connector system claimed in claim 13, wherein said adapter comprises:

a plurality of socket assemblies, each disposed at least partially in said shell, each having a distal end and a proximal end, each comprising a piston slideably disposed in a conductive tube at a distal end of said socket assembly, a first electrical contact at a proximal end of said socket assembly electrically connected to said tube, and a second electrical contact at said distal end of said socket assembly electrically connected to said tube, said piston movable into sealing engagement with one of said ports for sealing said second electrical contact against exposure to said external environment; and wherein said bladder contains dielectric fluid, at least a portion of said bladder enclosing at least one of said socket assemblies.

15. The convertible electrical connector system claimed in claim 13, wherein said at least one bladder comprises a main chamber bladder enclosing a portion of each of said socket assemblies.

16. The convertible electrical connector system claimed in claim 13, wherein said at least one bladder comprises a plurality of socket assembly bladders, each enclosing a portion of one of said socket assemblies.

17. The convertible electrical connector system claimed in claim 13, wherein said electrical contacts of said second connector comprise pins having a tip portion and a portion coated with a dielectric coating.

* * * * *